United States Patent [19]

Callender

[11] 4,061,337

[45] Dec. 6, 1977

[54] BOARD GAME APPARATUS

[76] Inventor: William Boyd Callender, 723 Marks Road, Valley City, Ohio 44280

[21] Appl. No.: 699,662

[22] Filed: June 25, 1976

[51] Int. Cl.[2] ..... A63F 3/00

[52] U.S. Cl. ..... 273/134 AT; 273/134 B; 273/134 C

[58] Field of Search ..... 273/134, 135

[56] References Cited

U.S. PATENT DOCUMENTS 3,994,500 11/1976 Schow ..... 273/134 C X

FOREIGN PATENT DOCUMENTS 451,954 10/1948 Canada ..... 273/135 B

*Primary Examiner*—Delbert B. Lowe

*Attorney, Agent, or Firm*—Meyer, Tilberry & Body

[57] ABSTRACT

A game is provided having educational and entertainment value with regard to music. The game includes a game board having spaces providing a path of movement for a game piece about the periphery of the board. Each movement of the game piece is determined from instruction cards placed face down on the game board in separate stacks each covered by a control card visibly depicting a different musical note. The game further includes chance cubes each having a different character letter thereon which corresponds to a note depicted on one of the control cards. The cubes are housed in a container and withdrawn one at a time by a player. In order to gain access to an instruction card to enable movement of his game piece, a player must compare the character letter on the cube with the notes depicted on the control cards and recognize the depicted note which corresponds to the character letter. Having done so the player is entitled to remove the underlying instruction card and move his game piece accordingly.

15 Claims, 7 Drawing Figures

FIG. 1
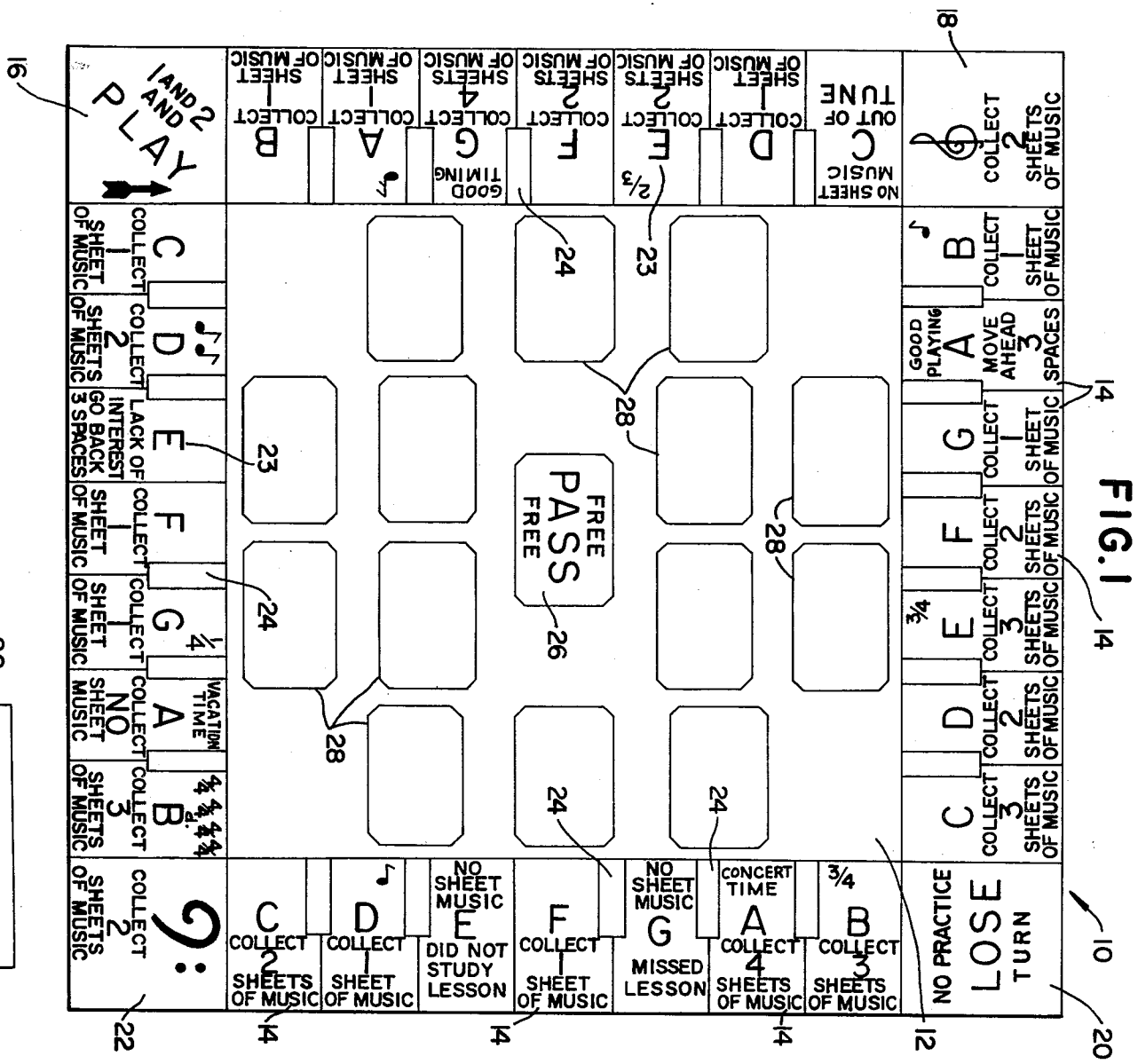
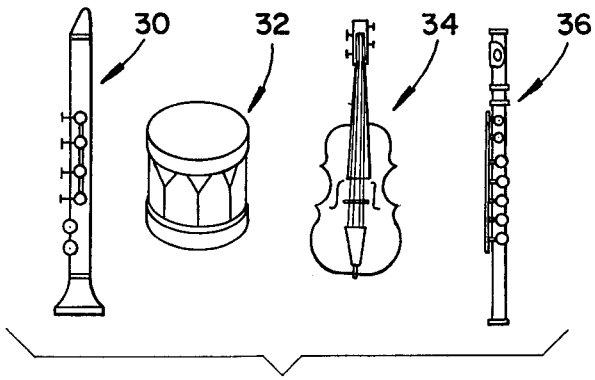
FIG. 2
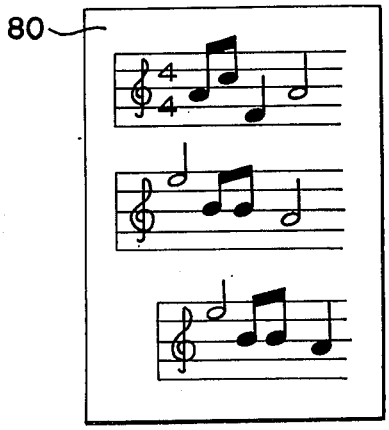
FIG. 6

BOARD GAME APPARATUS

This invention relates to the art of game apparatus and, more particularly, to a board-type game which is both educational and entertaining.

The present invention relates to a board-type game device in which a game piece is advanced by a player along a path defined on a game board by a plurality of spaces. A wide variety of board-type game devices involving such advancement of the game piece have been provided heretofore and, most often, the advance of a game piece by a player is determined by the roll of dice, indicia on a spinner device, or the like. Accordingly, movement of a game piece is controlled by chance along, and the entertainment value is determined by the instructions or the like provided in the spaces defining the path of game piece movement. There is no challenge to the player's ability to move his game piece when it is his turn to do so. In other words, the player does not participate in determining whether or not his game piece will be moved other than by manipulating the chance device.

In accordance with the present invention, a player mentally participates in the determination of whether or not his game piece is to be moved during a given turn. More particulary, a player's intelligence and concentration are challenged and he or she must meet the challenge in order to earn the right to move his game piece. The concentration and intelligence challenge is provided in accordance with the invention by requiring a player to recognize and associate two different forms of information which are combinable or associable in that they are alike in meaning or significance or are otherwise connected in thought. One of the forms of information is a representation provided to the player by chance. The second form of information is a plurality of different representations, one of which corresponds in meaning or significance or is connected in thought with the chance representation. If the player, upon comparison of the two forms of information, recognizes and properly combines the two associated representations, the player is entitled to move his game piece in accordance with instructions which are made available by such recognition. If the player is unable to combine the representations, then the proper combination can be brought to his attention, such as by other players, giving him the opportunity to learn. Thus, the player's learning ability is challenged. The game is made both entertaining and educational by so challenging a player's intelligence and concentration, and further entertainment value can be achieved by rewarding a player who has achieved the right to advance his game piece.

The present invention is described in detail hereinafter as a game device particularly suited for purposes of entertainment and education in conjunction with the field of music. The foregoing challenge with regard to whether or not a player can advance his game piece is achieved by requiring the player to properly associate one musical note representation obtained by chance with a corresponding musical note representation included in a visible field defined by a plurality of individual representations of different musical notes. The chance representation and the plurality of individual representations in the viewable field are of different forms in that, for example, the chance representation may be a character letter for a musical note, such as the letter "E," while each of the representations in the viewable field are depictions of notes on music lines.

Thus, the player is required to recognize the depicted musical note which corresponds to the character letter "E." If he does so, instructions are made available to him regarding advance ment of his game piece. If he fails to make the proper combination then he does not gain access to the instructions and cannot move his game piece.

While the game of the present invention is described in detail hereinafter in conjunction with education and entertainment in the field of music, it will be appreciated that the principles of the game are applicable to other fields wherein it is possible to teach and learn through the use of a concept of recognition of different representations which are associable through being like in meaning or significance or connected in thought.

It is accordingly an outstanding object of the present invention to provide a new game device which is both educational and entertaining.

Another object is the provision of a game device which requires player concentration and intelligence in determining whether or not a player's game piece is to be moved during a given turn.

A further object is the provision of a game device of the foregoing character which requires comparison by the player of two different representations and recognition of the association between the representations in order for the player to obtain the right to move his game piece.

Still a further object is the provision of a game device of the foregoing character which combines chance and player intelligence as a prerequisite for moving a game piece.

Yet another object is the provision of a game device of the foregoing character which enables education in conjunction with a given subject matter through recognition of different representations which are alike in meaning or significance, are connected in thought, or are otherwise associable in conjunction with the given subject matter.

Still another object is the provision of a game device of the foregoing character providing educational and entertainment value in the field of music.

The foregoing objects, and others, will in part be obvious and in part pointed out more fully hereinafter in conjunction with the written description of a preferred embodiment of the invention shown in the accompanying drawings in which:

FIG. 1 is a plan view of a game board for a game in accordance with the present invention.

FIG. 2 is a view in elevation of a number of game pieces shaped in representations of musical instruments;

FIG. 6 illustrates a small music sheet used as a player reward for advancement of a game piece; and, FIG. 7 shows 14 cards each having a different character letter thereon for musical notes on a musical scale from Low C through High B.

Figure 3:
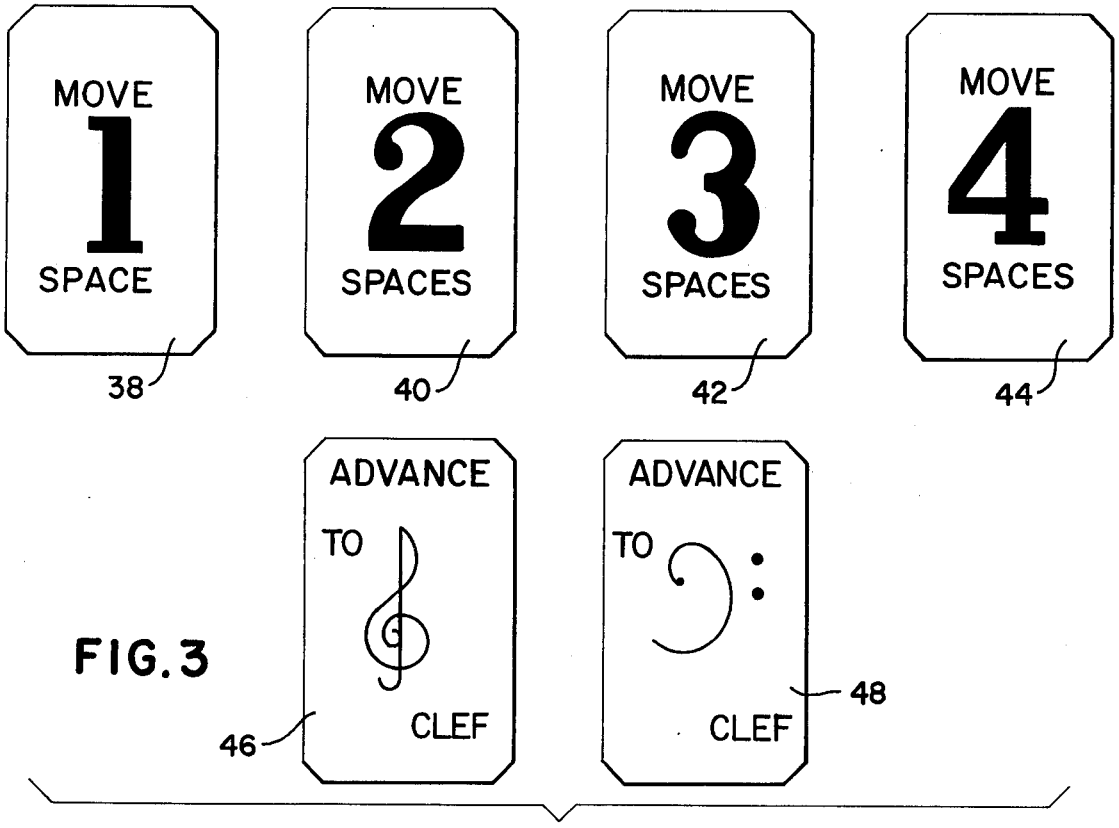
FIG. 3 illustrates instruction cards used to determine the extent or length of the moves of a game piece on the game board.

Referring now in greater detail to the drawings wherein the showings are for the purpose of illustrating a preferred embodiment of the invention only and not for the purpose of limiting the invention, the game board as shown in FIG. 1 is generally square and includes a central area 12 bounded by a path for movement of a game piece. The path extends completely around the game board and is defined by adjacent spaces 14 along the sides of the board and corner spaces 16, 18, 20 and 22. Each of the spaces 14, 16, 18, 20 and 22 is provided with directions for a player whose game piece lands thereon, as set forth more fully hereinafter. Preferably, each of the spaces 14 along each of the sides of the game board is provided with one of the character letters of a musical scale, designated in FIG. 1 by the numeral 23. These character letters serve to increase exposure of the players to notes of the scale and can be used in conjunction with instructions to move a game piece by designating a space to which a game piece is advanced. Additionally, the area between adjacent spaces 14 is provided with a darkened strip 24, whereby each side of the game board has the appearance of a piano keyboard. Central portion 12 is provided with fifteen delineated areas for receiving instruction cards, as set forth more fully hereinafter, including a central "Free Pass" area 26 and 14 additional areas 28 disposed thereabout.

The game is played by advancing game pieces along the path beginning at corner space 16. Any suitable game piece can be employed and, in the embodiment disclosed, game pieces in miniature forms of musical instruments are preferred in that there is educational value in the use thereof. Examples of such game pieces are shown in FIG. 2, wherein numerals 30, 32, 34 and 36 respectively designate a clarinet, a drum, a violin and a flute. It will be appreciated of course that any number of musical instruments can be provided as well as musical instrument of any desired form.

In playing the game, a player's game piece is advanced along the path in accordance with instructions appearing on instruction cards, such as cards 38, 40, 42, 44, 46 and 48 shown in FIG. 3 of the drawings. A sufficient quantity of each of the cards shown in FIG. 3 is provided to enable a predetermined equal number of the cards to be placed in each of the card receiving areas 26 and 28 on the game board. If, for example, it is desired to have three cards stacked in each of the areas 26 and 28, a total of 45 instruction cards would be required. The instruction cards are shuffled and dealt into the areas 26 and 28 face down. As set forth more fully hereinafter, a player must gain access to one of the stacks of cards in areas 26 and 28 in order to advance his game piece during a given turn.

Figure 4:
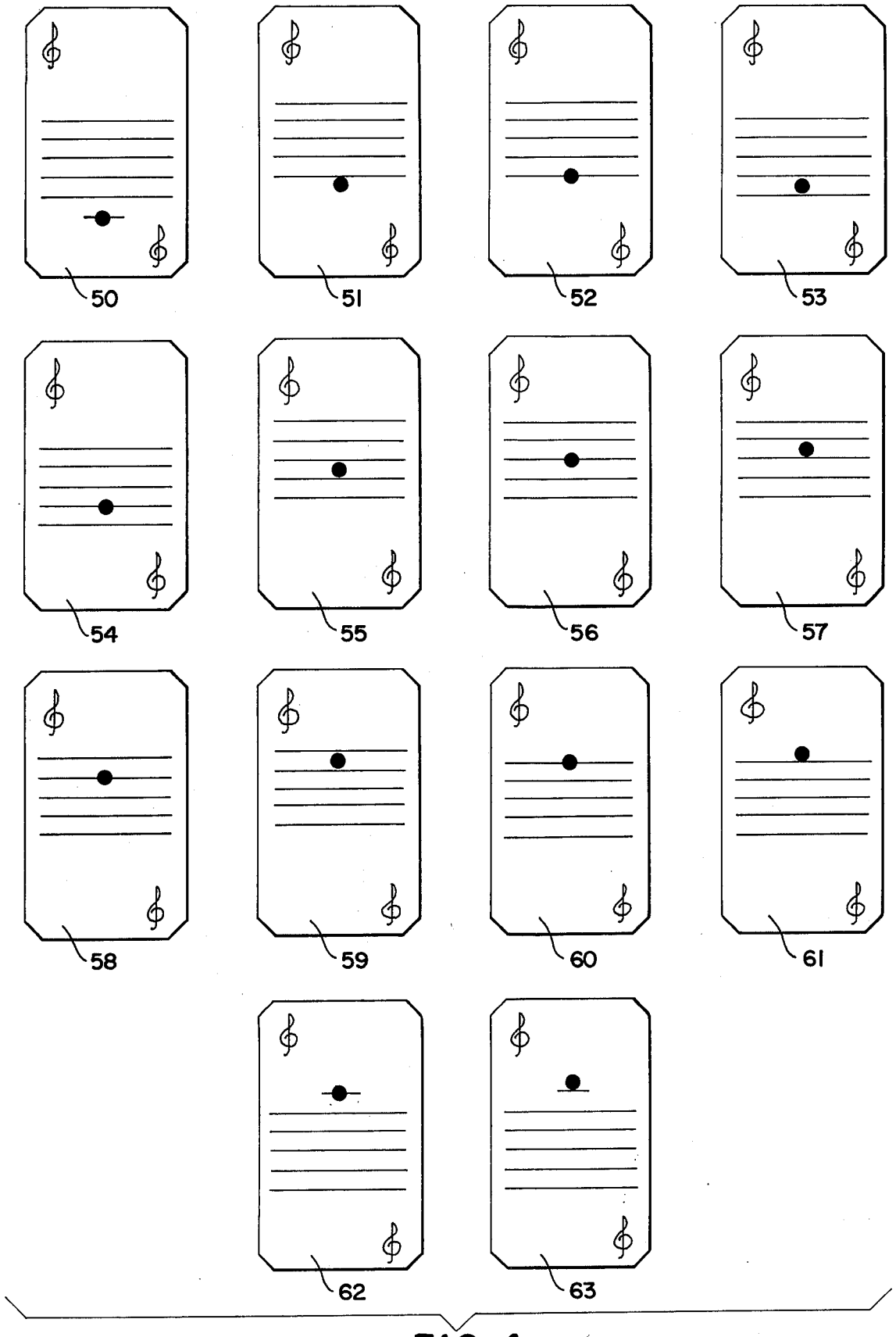
FIG. 4 shows a set of 14 note cards each depicting a different musical note for a musical scale from Low C to High B.

Referring now to FIG. 4, there are shown 14 note cards numbered consecutively from 50 to 63. Each of the cards 50–63 includes the depiction of a different note for a musical scale. Each note is displayed on music lines, and notes are provided for a scale from Low C through High B. More particularly, the notes depicted on the individual cards are as follows:

| | |
|---|---|
| Card 50 - Low C | Card 57 - High C |
| Card 51 - Low D | Card 58 - High D |
| Card 52 - Low E | Card 59 - High E |
| Card 53 - Low F | Card 60 - High F |
| Card 54 - Low G | Card 61 - High G |
| Card 55 - Low A | Card 62 - High A |
| Card 56 - Low B | Card 63 - High B |

Each of the cards 50–63 is placed face up on a different one of the stacks of instruction cards in areas 28 of the playing board. The center "Free Pass" stack is left uncovered. Further, cards 50–63 are preferably randomly positioned on the stacks in areas 28 so as not to be in sequence.

Figure 5:
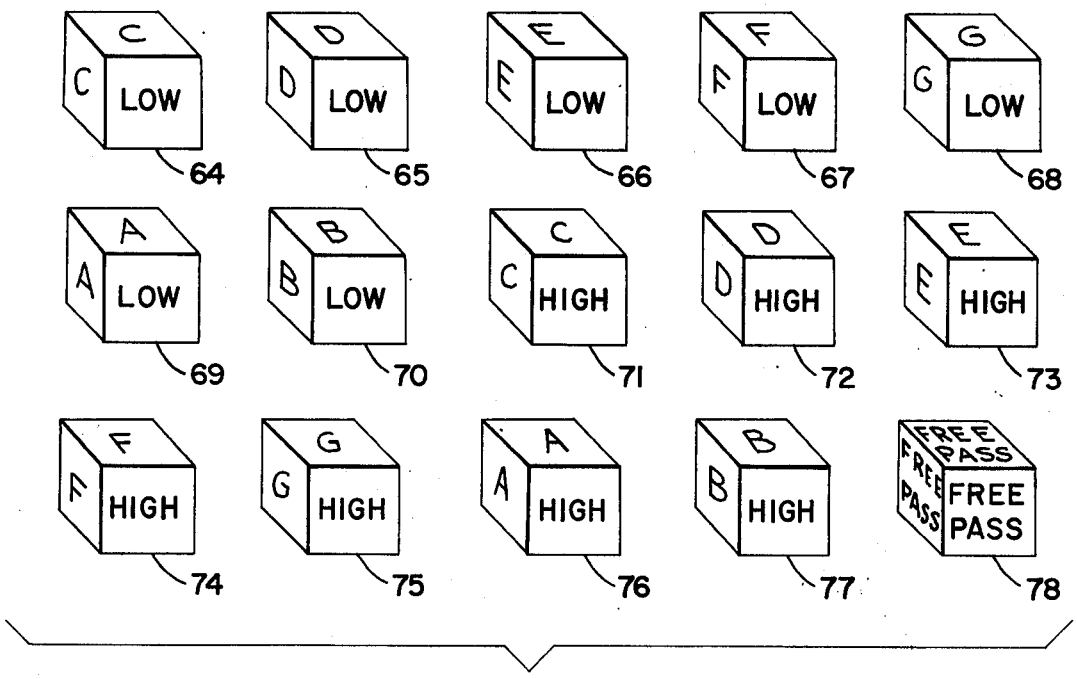
FIG. 5 illustrates 15 chance cubes including fourteen cubes each having a different character letter thereon for musical notes on a scale from Low C through High B.

Referring now to FIG. 5 of the drawing, there are illustrated 15 chance cubes numbered consecutively from 64 through 78. Each of the cubes 64–77 is provided with a different character letter of a musical scale from Low C to High B. Accordingly, it will be appreciated that there is a chance cube having a character letter corresponding with the note depicted on one of the note cards 50–63. More particularly, the correspondence between chance cards and note cards is as follows:

| | |
|---|---|
| Card 50 - Cube 64 | Card 57 - Cube 71 |
| Card 51 - Cube 65 | Card 58 - Cube 72 |
| Card 52 - Cube 66 | Card 59 - Cube 73 |
| Card 53 - Cube 67 | Card 60 - Cube 74 |
| Card 54 - Cube 68 | Card 61 - Cube 75 |
| Card 55 - Cube 69 | Card 62 - Cube 76 |
| Card 56 - Cube 70 | Card 63 - Cube 77 |

Cube 78 is a "Free Pass" cube which entitles a player to withdraw an instruction card from the "Free Pass" stack.

In play of the game, cubes 64–78 are placed in a suitable container and one of the cubes is withdrawn by a player to inititate his turn. In order for the player to continue his turn, he must compare the character letter of the withdrawn cube with the notes depicted on cards 50–63 and properly associate the letter character with the card depicting the corresponding note. For example, if the player withdraws chance cube 67 from the receptical which bears the letter character "Low F," he must associate that cube with note card 53 which depicts the Low F note on the lines of music on the card. If he makes the proper association he is then entitled to withdraw the top instruction card from beneath note card 53 and move his game piece accordingly. If he is unable to make the proper association between the chance cube and note cards he forfeits his opportunity to advance his game piece.

Referring once again to FIG. 1 of the drawing, it will be noted that spaces 14 and corners 18, 20 and 22 of the path of movement for a game piece include indicia providing further directions which may be either advantageous or disadvantageous to the player landing on a particular space. A considerable number of the spaces 14 and corners 18 and 22 indicate an award to a player landing thereon. As indicated in FIG. 1, the awards are in the form of sheets of music. These are simply sheets of paper having musical representations thereon, such as the sheet 80 shown in FIG. 6 of the drawing. THe duration of the game can be determined by the first player to collect a predetermined number of sheets of music. Alternatively, the game can be played for a predetermined amount of time with the winner being the player having accumulated the most sheets of music at the termination of the time period.

It will be further noted from FIG. 1 that certain of the spaces 14 and corner 20 are provided with directions which are disadvantageous to the player, such as losing a turn, or collecting no sheets of music. All such directions for the players enhance enjoyment of the game. It will be appreciated, of course, that the directions can be varied from those shown in FIG. 1 without departing from the principles of the present invention.

Figure 7:
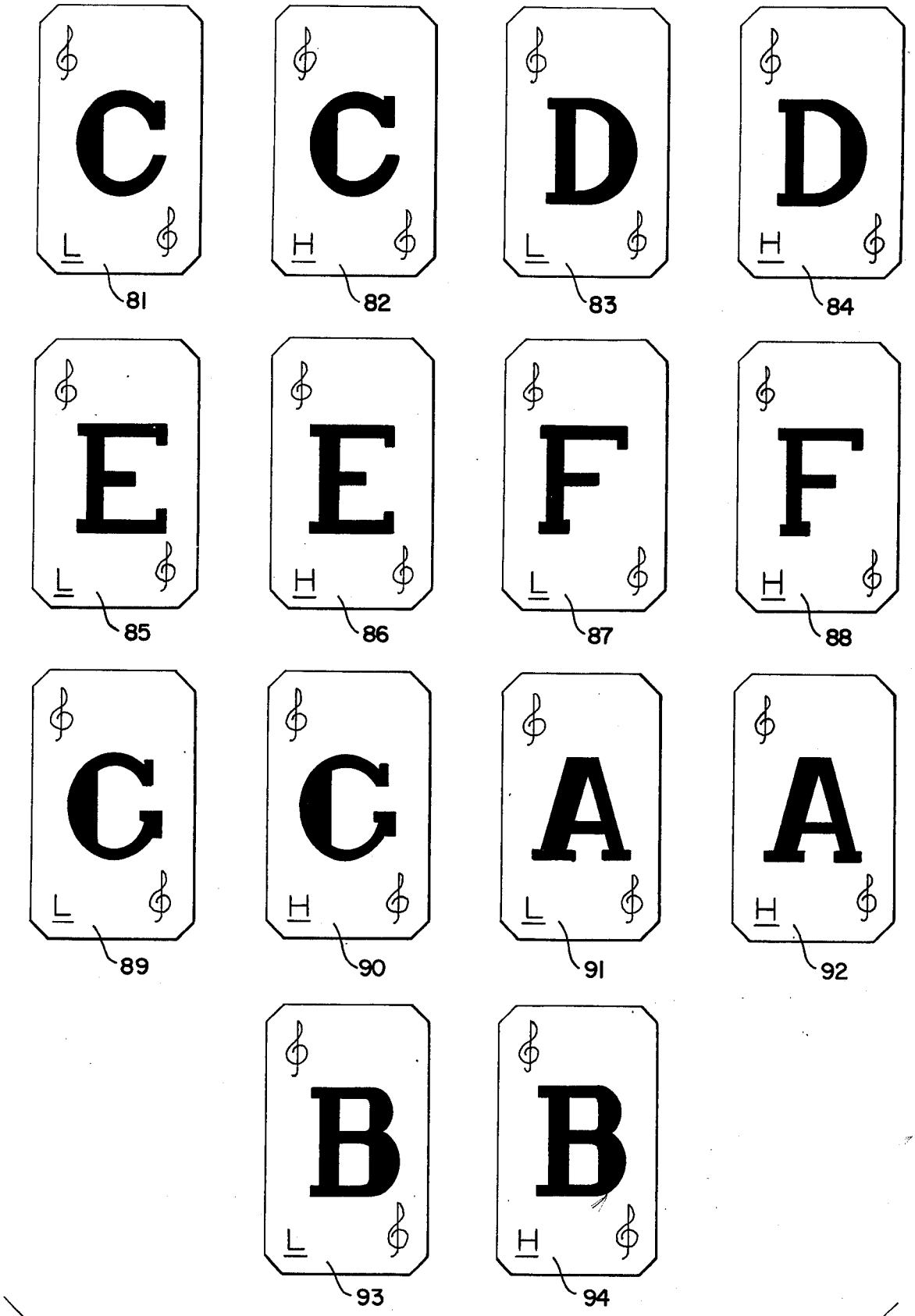

FIG. 7 illustrates 14 letter cards consecutively numbered from 81 through 94. As will become apparent hereinafter cards 81–94 provide an alternative to the use of chance cubes as described above and, additionally, provide for the possibility of employing note cards 50–63 as chance cards. In this respect, cards 81–94 each include a character letter of a musical scale from Low C to High B. In this respect, for example, the letter "L" in the lower left hand corner of card 81 indicates Low C, whereby card 81 corresponds with note card 50 in FIG. 4. Similarly, the "H" in the lower left hand corner of card 82 designates High C on the music scale, whereby card 82 corresponds with note card 57 in FIG. 4. Accordingly, it will be appreciated that each of the cards 81–94 corresponds with one of the note cards 50–63 in FIG. 4. Therefore, it will be further appreciated that cards 81–94 can be shuffled, placed face down in a stack, and a top card withdrawn to provide a chance card which the player must compare with the note cards on top of the instruction cards, as described hereinbefore.

Cards 81–94 also provide for note cards 50–63 to be employed as chance cards. In this respect, cards 81–94 can be shuffled and each card placed face up on a different one of the stacks of the instruction cards in areas 28 of the game board. Note cards 50–63 can then be shuffled and one of the cards withdrawn from the pack to provide a chance card which the player must then compare with cards 81–94 in an effort to make the proper association necessary to enable him to gain access to an instruction card.

It will be appreciated from the foregoing description of the use and interchangeability of cards 50–63 and 81–94 that cards 81–94 could be used to cover the stacks of instruction cards and that the chance cubes 64–77 could be provided with depictions of music notes like those provided on note cards 50–63. It will be further appreciated that, regardless of which cards are employed to cover the instruction cards, the covering cards and the chance device together control access to the instruction cards.

It will be noted that the musical representations appearing on note cards 50–63 and letter cards 81–94 include the symbol for the treble of G-clef. It will be appreciated that similar sets of cards can be provided with the symbol for the Bass or F-clef, thus increasing the educational value of the game. Additionally, it will be appreciated that note and character letter cards and chance cubes can be provided to include sharps and flats, thus increasing the difficulty of the game as well as the educational value thereof. Still further, while 14 areas 28 are provided on the game board shown in FIG. 1, it will be appreciated that this number can be increased or decreased to accommodate a number of scale octaves other than two, or to accommodate the use of sharps and flats in one or more scale octaves.

While chance cards and cubes are herein illustrated and described as providing a chance capability for use by a player, it will be appreciated that other chance devices can be readily employed. For example, a spinner device, or a single multi-faceted block to be rolled like a die could be employed to provide the player with a chance representation for comparison with the representations on control cards covering the instruction cards. Moreover, it will be appreciated that the instruction cards could be replaced by a spinner device which the player would be entitled to actuate upon making the proper association of representations between a chance device and a corresponding note or letter control card which would then alone occupy one of the area 28 upon the playing board. Another possible modification would be to provide a game board with instructions in the form of a plurality of spinning devices, one in each of the areas 26 and 28 and which the player would be entitled to actuate upon making the proper association between a chance device and a note or letter control card covering the spinner. As an alternative to using control cards in the latter arrangement, each of the areas 28 could be provided with fixed indicia as, for example, that provided by note cards 50–63.

Many modifications and rearrangements of the component parts of the game and their manner of employment will be obvious from the foregoing description of the preferred embodiment and can be made without departing from the principles of the present invention. It is only necessary in accordance with the present invention for the chance device to provide at one time, a single representation in a form different from but associable with one of a plurality of second representations, whereby the player is required to recognize and make the proper association in order to earn the right to continue with his turn. Accordingly, it will be appreciated that the chance representation need not be in the form of a card, cube, spinning device or other visual media, but rather could be an audible representation of a character letter of a musical scale which would then require the player to designate the visible representation corresponding thereto. Additionally, it will be appreciated that the representations provided by note cards 50–63 in areas 28 of the game board in the embodiment described hereinabove could well be provided on a chart or the like separate from the game board and in conjunction with a single stack of instruction cards, a spinner device, or any other suitable arrangement for providing instructions to a player properly associating the representation on the chance device with a representation on such a control chart.

While considerable emphasis has been placed herein on the applicability of the game of the present invention in the field of music, the principle of the game is readily applicable to any learning or entertaining situation wherein it is possible to establish two different representations which are alike in meaning or significance or are connected in thought so that a single one of a first of the two sets of representations which is chance derived can be compared with the second set of representations in a player's effort to recognize and properly associate the chance derived representation with the corresponding representation in the second set. For example, the game can readily be applied to the field of mathematics. In this respect, for example, chance cubes could be provided with numbers, and the cards covering the instruction cards could be provided with addition, subtraction, multiplication, or division facts corresponding to the numbers on the chance cubes. More particularly, for example, the number 16 on a chance cube could correspond with 24 minus 8 on the cards covering the instruction cards. The game could similarly be employed in connection with article identification. In this respect, for example, pictures of animals could be provided on the cards covering the instruction cards, and the spelling of the animals' names could be on cards, a spinner device, or other arrangements to provide the necessary chance capability. A wide variety of applications of the game will be suggested or obvious from the foregoing description.

As many possible embodiments of the present invention may be made, and as many possible changes may be made in the embodiment herein illustrated and described, it is to be distinctly understood that the foregoing descriptive matter is to be interpreted merely as illustrative of the present invention and not as a limitation.

What is claimed is:

1. A game including a game board having spaces providing a path of movement for a game piece, instruction means for determining the extent of a player's movement of a game piece along said path, and first and second means associable by comparison by a player to determine whether the player gains access to said instruction means.

2. The game according to claim 1, wherein said first means of said first and second means includes means bearing a plurality of visible and different first indicia and said second means of said first and second means is chance means for providing at one time a single one of a plurality of second indicia each associable with one of said plurality of first indicia.

3. The game according to claim 1, wherein said first means of said first and second means includes a plurality of indicia bearing cards each having indicia thereon different from the others and said second means of said first and second means is chance means for providing at one time a single one of a plurality of indicia each associable with the indicia on one of said plurality of cards.

4. The game according to claim 3, wherein said instruction means are instruction bearing cards.

5. The game according to claim 4, wherein said chance means includes multi-faceted block means having indicia on at least one of the facets thereof associable with the indicia on one of said plurality of cards.

6. The game according to claim 1, wherein said first means of said first and second means provides a first plurality of musical representations and said second means of said first and second means is chance means for providing at one time a single one of a plurality of musical representations each synonymous with one of said first plurality of representations.

7. The game according to claim 6, wherein one of said first and second pluralities of musical representations is comprised of depictions of musical notes and the other is comprised of corresponding character letters for the musical notes.

8. The game according to claim 6, wherein said first means of said first and second means includes a plurality of control cards each bearing a different musical representation.

9. The game according to claim 8, wherein each of said control cards depicts a musical note and said second plurality of musical representations are character letters corresponding to said musical notes.

10. The game according to claim 9, wherein said chance means includes multi-faceted block means having a character letter on at least one of the facets thereof corresponding to one of said musical notes.

11. The game according to claim 10, wherein said block means includes a plurality of blocks each having a different character letter thereon.

12. The game according to claim 8, wherein said instruction means includes a plurality of instruction bearing cards.

13. The game according to claim 12, wherein each of said control cards depicts a musical note and said second plurality of musical representations are character letters corresponding to said musical notes.

14. The game according to claim 13, wherein said chance means includes a plurality of multi-faceted blocks each having a single character letter on at least one of the facets thereof.

15. The game according to claim 13, wherein said game board includes a peripheral edge and a central portion, said spaces providing for said path to extend uninterrupted about said board between said edge and said central portion, and at least seven separate areas delineated in said central portion for receiving pluralities of said instruction cards and an associated control card.

* * * * *